US006474088B2

(12) United States Patent
Minowa et al.

(10) Patent No.: US 6,474,088 B2
(45) Date of Patent: Nov. 5, 2002

(54) THERMAL EXPANSION VALVE

(75) Inventors: Masakatsu Minowa; Kazuhiko Watanabe, both of Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 10/098,311

(22) Filed: Mar. 18, 2002

(65) Prior Publication Data

US 2002/0100287 A1 Aug. 1, 2002

Related U.S. Application Data

(62) Division of application No. 09/925,681, filed on Aug. 10, 2001.

(30) Foreign Application Priority Data

Aug. 10, 2000 (JP) ..... 2000-242271

(51) Int. Cl.[7] ..... F25B 41/04; G05D 23/00
(52) U.S. Cl. ..... 62/225; 236/92 B
(58) Field of Search ..... 62/225; 236/92 B

(56) References Cited

U.S. PATENT DOCUMENTS 4,468,054 A 8/1984 Orth
5,361,597 A 11/1994 Hazime et al.
5,943,871 A * 8/1999 Ito et al. ..... 236/92 B

FOREIGN PATENT DOCUMENTS

EP 0 569 619 A1 11/1983
EP 0 829 690 A1 3/1998
JP 10089811 10/1996

OTHER PUBLICATIONS

European Search Report, EP 01 11 7123, Jan. 24, 2002.

* cited by examiner

*Primary Examiner*—William E. Tapolcai
*Assistant Examiner*—Mohammad M. Ali
(74) *Attorney, Agent, or Firm*—Rader, Fishman & Grauer PLLC

(57) ABSTRACT

A heat transmission retardant member 140 is formed of a cup-like shaped resin material utilizing nylon or polyacetals, comprising a collar 141, and a thick-walled cylinder portion 143 having at the lower end thereof a tapered portion 142. Said retardant member 140 contacting the outer surface of a heat-sensing driven member 100. Said retardant member 140 is mounted to said driven member 100 so as to cover the outer surface thereof and being mounted outside the second refrigerant passage 63, said cylinder portion 143 defining a space 144 between the exterior of the driven member 100 and the interior of said cylinder portion 143. By the existence of the activated carbon 70, the hunting phenomenon and the invasion of the refrigerant to a lower chamber 85 is prevented, and the heat from the heat transmission retardant member 140 is transmitted to the heat sensing driven member 100 via space 144 which enables to provide a further retardation to the response of the valve to the temperature change of the refrigant exiting the evaporator. The hunting is further suppressed effectively.

2 Claims, 6 Drawing Sheets

PRIOR ART

PRIOR ART

THERMAL EXPANSION VALVE

This application is a division of 09/925,681 filed on Aug. 10, 2001.

FIELD OF THE INVENTION

The present invention relates to a thermal expansion valve used in a refrigeration cycle.

DESCRIPTION OF THE RELATED ART

Conventionally, a thermal expansion valve shown in FIG. 5 is used in a refrigeration cycle in order to control the flow rate of the refrigerant being supplied to an evaporator and to decompress the refrigerant.

In FIG. 5, a prism-shaped aluminum valve body 510 comprises a first refrigerant passage 514 including an orifice 516, and a second refrigerant passage 519, the two passages formed mutually independent from one another. One end of the first refrigerant passage 514 is communicated to the entrance of an evaporator 515, and the exit of the evaporator 515 is communicated through the second refrigerant passage 519, a compressor 511, a condenser 512 and a receiver 513 to the other end of the first refrigerant passage 514. Abias means 517 which is a bias spring biasing a sphere-shaped valve means 518 is formed to a valve chamber 524 communicated to the first refrigerant passage 514, and the valve means 518 is driven toward or away from the orifice 516. Further, the valve chamber 524 is sealed by a plug 525, and the valve means 518 is biased through a support member 526. A power element 520 including a diaphragm 522 is fixed to the valve body 510 adjacent to the second refrigerant passage 519. An upper chamber 520*a* in the power element 520 defined by the diaphragm 522 is maintained airtight, and it is filled with temperature-corresponding working fluid.

A small pipe 521 extending out from the upper chamber 520*a* of the power element 520 is used to degasify the upper chamber 520*a* and to fill the temperature-corresponding working fluid to the upper chamber 520*a*, before the end of the pipe is sealed. The extended end of a valve drive member 523 functioning as the heat-sensing/transmitting member positioned within the valve body 510 extending from the valve means 518 and penetrating through the second refrigerant passage 519 is positioned in the lower chamber 520*b* of the power element 520, contacting the diaphragm 522. The valve drive member 523 is made of a material having a large thermal capacity, and it transmits the temperature of the refrigerant vapor exiting the evaporator 515 and flowing through the second refrigerant passage 519 to the temperature-corresponding working fluid filled to the upper chamber 520*a* of the power element 520, which generates a working gas having a pressure corresponding to the transmitted temperature. The lower chamber 520*b* is communicated to the second refrigerant passage 519 through the space formed around the valve drive member 523 within the valve body 510.

Accordingly, the diaphragm 522 of the power element 520 uses the valve drive member 523 to adjust the valve opening of the valve means 518 against the orifice 516 (that is, the amount of flow of liquid-phase refrigerant entering the evaporator) according to the difference in pressure of the working gas of the temperature-corresponding working fluid filling the upper chamber 520*a* and the pressure of the refrigerant vapor exiting the evaporator 515 in the lower chamber 520*b*, under the influence of the biasing force of the bias means 517 provided to the valve means 518.

According to the above-mentioned prior-art thermal expansion valve, the power element 520 is exposed to external atmosphere, and the temperature-corresponding driving fluid in the upper chamber 520*a* receives influence not only from the temperature of the refrigerant exiting the evaporator and transmitted by the valve drive member 423 but also from the external atmosphere, especially the engine room temperature. Moreover, the above conventional valve structure often caused a so-called hunting phenomenon where the valve responds too sensitively to the refrigerant temperature at the exit of the evaporator and repeats the opening and closing movement of the valve means 518. The hunting phenomenon is caused for example by the structure of the evaporator, the method of positioning the pipes of the refrigeration cycle, the method of using the expansion valve, and the balance with the heat load.

Conventionally, a time constant retardant such as an absorbent or a thermal ballast is utilized to prevent such hunting phenomenon. FIG. 6 is a cross-sectional view showing the conventional thermal expansion valve utilizing an activated carbon as an adsorbent, the structure of which is basically similar to the prior-art thermal expansion valve of FIG. 5, except for the structure of the diaphragm and the structure of the valve drive member that functions as a heat-sensing driven member. According to FIG. 6, the thermal expansion valve comprises a prism-shaped valve body 50, and the valve body 50 comprises a port 52 through which the liquid-phase refrigerant flowing through a condenser 512 and entering from a receiver tank 513 travels into a first passage 62, a port 58 sending the refrigerant traveling through the first passage 62 out toward an evaporator 515, an entrance port 60 of a second passage 63 through which the gas-phase refrigerant exiting the evaporator returns, and an exit port 64 through which the refrigerant exits toward the compressor 511.

The port 52 through which the refrigerant is introduced is communicated to a valve chamber 54 positioned on the center axis of the valve body 50, and the valve chamber 54 is sealed by a nut-type plug 130. The valve chamber 54 is communicated through an orifice 78 to a port 58 through which the refrigerant exits toward the evaporator 515. A sphere-shaped valve means 120 is mounted to the end of a small-diameter shaft 114 that penetrates the orifice 78, and the valve means 120 is supported by a support member 122. The support member 122 biases the valve means 120 toward the orifice 78 using a bias spring 124. The area of the flow path for the refrigerant is adjusted by varying the gap formed between the valve means 120 and the orifice 78. The refrigerant sent out from the receiver 514 expands while passing through the orifice 78, and travels through the first passage 62 and exits from the port 58 toward the evaporator. The refrigerant exiting the evaporator enters from the port 60, and travels through the second passage 63 and exits from the port 64 toward the compressor.

The valve body 50 is equipped with a first hole 70 formed from the upper end portion along the axis, and a power element portion 80 is mounted to the first hole using a screw portion and the like. The power element portion 80 includes housings 81 and 91 that constitute the heat sensing portion, and a diaphragm 82 that is sandwiched between these housings and fixed thereto through welding. The upper end portion of a heat-sensing driven member 100 made of stainless steel or aluminum is welded onto a round hole or opening formed to the center area of the diaphragm 82 together with a diaphragm support member 82'. The diaphragm support member 82' is supported by the housing 81.

An inert gas is sealed inside the housing 81, 91 as a temperature-corresponding working fluid, which is sealed thereto by the small tube 21. Further, a plug body welded to the housing 91 can be used instead of the small tube 21. The diaphragm 82 divides the space within the housing 81, 91 forming an upper chamber 83 and a lower chamber 85.

The heat-sensing driven member 100 is constituted of a hollow pipe-like member exposed to the second passage 63, with activated carbon 40 stored to the interior thereof. The upper end of the heat-sensing/pressure transmitting member 100 is communicated to the upper chamber 83, defining a pressure space 83*a* by the upper chamber 83 and the hollow portion 84 of the heat-sensing driven member 100. The pipe-like heat-sensing driven member 100 penetrates through a second hole 72 formed on the axis of the valve body 50, and is inserted to a third hole 74. A gap is formed between the second hole 72 and the heat-sensing driven member 100, through which the refrigerant within the passage 63 is introduced to the lower chamber 85 of the diaphragm.

The heat-sensing driven member 100 is slidably inserted to the third hole 74, and the end thereof is connected to one end of the shaft 114. The shaft 114 is slidably inserted to a fourth hole 76 formed to the valve body 50, and the other end thereof is connected to the valve means 120.

According to this structure, the adsorbent 40 functioning as a time constant retardant works as follows. When a granular activated carbon is used as the adsorbent 40, the combination of the temperature-corresponding working fluid and the adsorbent 40 is an absorption-equilibrium type, where the pressure can be approximated by a linear expression of the temperature within a considerably wide temperature range, and the coefficient of the linear expression can be set freely according to the amount of granular activated carbon used as the adsorbent. Therefore, the characteristic of the thermal expansion valve can be set at will.

Accordingly, it takes a relatively long time to set the adsorption-equilibrium-type pressure-temperature equilibrium state when the temperature of the refrigerant vapor flowing out from the exit of the evaporator 515 is either rising or falling. In other words, by increasing the time constant, the work efficiency of the air conditioning device is improved, stabilizing the performance of the air conditioning device capable of suppressing the sensitive operation of the thermal expansion valve caused by the influence of disturbance which may lead to the hunting phenomenon.

SUMMARY OF THE INVENTION

However, the hunting phenomenon differs according to the work characteristic of each individual refrigeration cycle. Especially when a fine temperature variation occurs to the low-pressure refrigerant exiting the evaporator, the small fluctuation or pulsation of the refrigerant temperature is transmitted directly to the opening/closing movement of the valve means, which causes unstable valve movement, and the use of a thermal ballast material or an adsorbent can no longer suppress hunting.

Therefore, the present invention aims at providing a thermal expansion valve that enables to control stably the amount of low-pressure refrigerant sent out towards the evaporator, and that enables to further suppress the hunting phenomenon by providing an appropriate delay to the response of the valve to temperature change, even when small temperature variation occurs to the low-pressure refrigerant transmitted from the evaporator. This is realized without changing the basic design of the conventional thermal expansion valve, maintaining the conventional operation of the valve.

In order to achieve the above objects, the present invention provides a thermal expansion valve including a refrigerant passage extending from an evaporator to a compressor, and a heat-sensing driven member with a hollow portion formed to the interior thereof and having a heat sensing function that is positioned within the refrigerant passage; wherein the end of the hollow portion of the heat-sensing driven member is fixed to the center opening portion of a diaphragm constituting a power element portion that drives the driven member, thereby communicating the hollow portion with an upper pressure chamber defined by the diaphragm within the power element portion and forming a sealed space filled with working fluid, the hollow portion storing a time constant retardant material; and a heat transmission retardant member is mounted outside the refrigerant passage covering and forming a space between the outer circumferential surface of said heat-sensing driven member.

The thermal expansion valve of the present invention having the above-explained structure is realized without changing the basic structure of the conventional thermal expansion valve, but by providing a heat transmission retardant material to the outer circumferential surface of the heat-sensing driven member. The present invention not only delays the temperature transmission from the heat-sensing driven member to the time constant retardant material and thereby enables to further increase the time constant compared to the valve where only the time constant retardant is utilized, but also forms a space between the heat-sensing driven member and the heat transmission retardant member which provides a double effect of delaying the transmission of temperature variation of the refrigerant to the heat-sensing driven member. Therefore, the present invention enables to further effectively suppress hunting of the valve means.

Moreover, the-present invention further provides a thermal expansion valve including a refrigerant passage extending from an evaporator to a compressor, and a heat-sensing driven member with a hollow portion formed to the interior thereof and having a heat sensing function that is positioned within the refrigerant passage; wherein the end of the hollow portion of the heat-sensing driven member is fixed to the center opening portion of a diaphragm constituting a power element portion that drives the driven member, thereby communicating the hollow portion with an upper pressure chamber defined by the diaphragm within said power element portion and forming a sealed space filled with working fluid, the hollow portion storing a time constant retardant material; and a heat transmission retardant member including a thick-wall portion and a thin-wall portion is mounted to and covers the outer circumferential surface of the heat-sensing driven member, the thick-wall portion mounted outside the refrigerant passage and forming a space between the outer circumferential surface, and the thin-wall portion mounted within said refrigerant passage.

The above-explained structure does not change the basic structure of the conventional thermal expansion valve, but instead, provides a heat transmission delay member having a thick-wall portion and a thin-wall portion mounted to cover the outer circumferential surface of the heat-sensing driven member. Here, the thick-wall portion is mounted to the outside of a refrigerant passage so as to form a space between the outer circumferential surface thereby delaying the transmission of temperature variation of the refrigerant to the heat-sensing driven member, and the thin-wall portion provides delay while transmitting the temperature change of the refrigerant to the heat-sensing driven member without blocking the flow of refrigerant traveling through the refrigerant passage. Therefore, the present invention suppresses the hunting of the valve means even more effectively.

DETAILED DESCRIPTION OF PREFERRED EMBODIMENTS

Now, the embodiments of the present invention will be explained with reference to the drawings.

Figure 1:
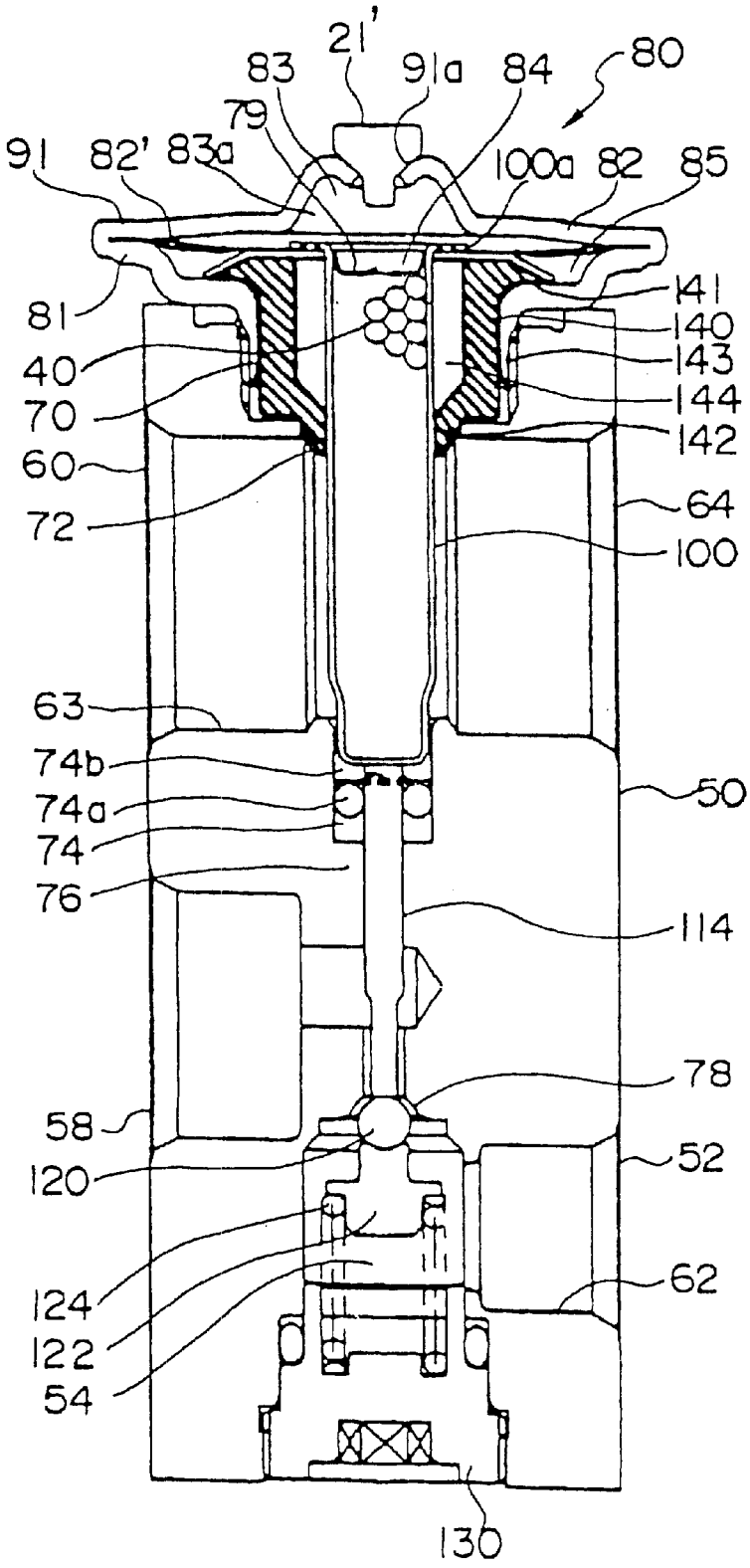
FIG. 1 is a vertical cross-sectional view showing one embodiment of the thermal expansion valve according to the present invention.
Figure 2:
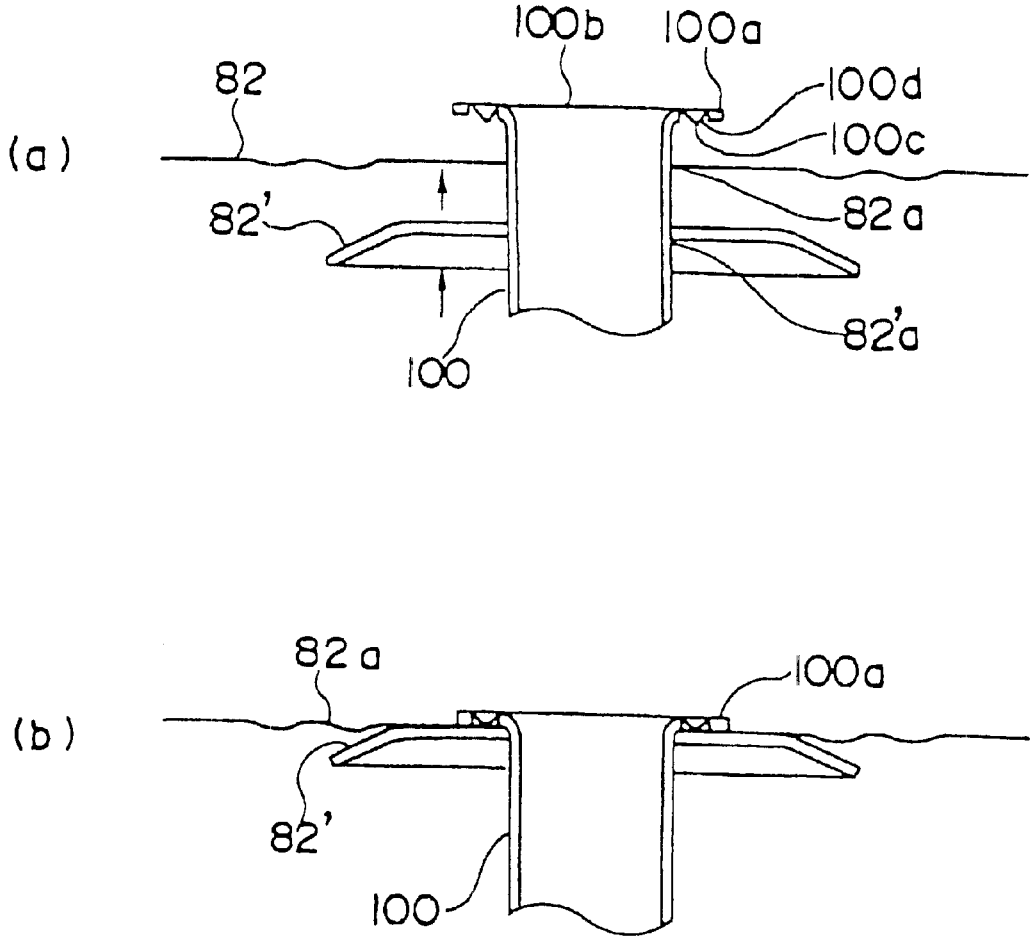
FIG. 2 is an exploded view of the main portion explaining the embodiment shown in FIG. 1.

FIG. 1 is a vertical cross-sectional view showing the structure according to one embodiment of the thermal expansion valve of the present invention, and FIG. 2 is a cross-sectional view showing the main portion thereof. In the embodiment shown in FIG. 1, the basic structure of the present valve is the same as that of the conventional thermal expansion valve, so the identical or equivalent portions of the present valve are provided with the same reference numbers as those of the conventional valve, and the explanations thereof are omitted. Only the portions that differ from the conventional valve are explained here.

In FIG. 1, 140 refers to a heat transmission retardant member, which is a cup-like member made of resin utilizing nylon or polyacetals and the like. The retardant member 140 comprises a collar 141 formed to the outside of the upper end thereof and a large-diameter cylinder portion 143 having thick walls which is tapered at the lower end forming a tapered portion 142. The upper end of the member 140 contacts a support member 82' explained later, the collar 141 is supported by the inner surface of a housing 81, and the outer surface of the cylinder portion 143 contacts the inner surface of the housing 81. The tip of the tapered portion 142 of the member 140 is inserted to the interior of a second hole 72 and contacts the outer surface of the heat-sensing driven member 100, positioned within a lower chamber 85 defined by a diaphragm 82. Accordingly, when the heat transmission retardant member 140 is mounted to the heat-sensing driven member 100, the retardant member 140 covers the external surface of the heat-sensing driven member 100 and is mounted to the exterior of the refrigerant passage of the second passage 63. Further, the tapered portion 142 defines a space 144 between the external surface of the heat-sensing driven member 100 and the inner surface of the cylinder portion 143.

According to the present invention, not only is the hunting phenomenon suppressed by the existence of the activated carbon 40, but the invasion of the refrigerant to the lower chamber 85 is prevented, and the heat from the heat transmission retardant member 140 is transmitted to the heat-sensing driven member 100 via space 144, the existence of which enables to provide a further retardation to the response of the valve against the temperature change of the refrigerant exiting the evaporator. Therefore, the hunting phenomenon is even more suppressed effectively. Moreover, the present thermal expansion valve can be formed without changing the basic structure of the conventional thermal expansion valve, so an appropriate delay can be provided to the temperature variation of the refrigerant by setting the thickness of the cylinder portion 143 of the heat transmission retardant 140 and the area of the space 144.

In the embodiment shown in FIG. 1, the evaporator, the compressor, the condenser and the receiver constituting the refrigeration cycle are omitted from the drawing. Reference 21' is a stainless steel plug body for sealing into the upper chamber 83 a predetermined refrigerant working as a temperature working fluid that drives the diaphragm 82, and it is welded so as to plug the hole 91*a* formed to the housing 91. Reference 74*a* refers to an o-ring mounted to a shaft 114 within a third hole 74, and 74*b* is a push nut preventing movement of the o-ring. Reference 79 is a lid having a protrusion for pushing down the adsorbent, for example an activated carbon, arranged inside the hollow portion of the heat-sensing driven member 100, and it is press-fit to the hollow portion.

Figure 6:
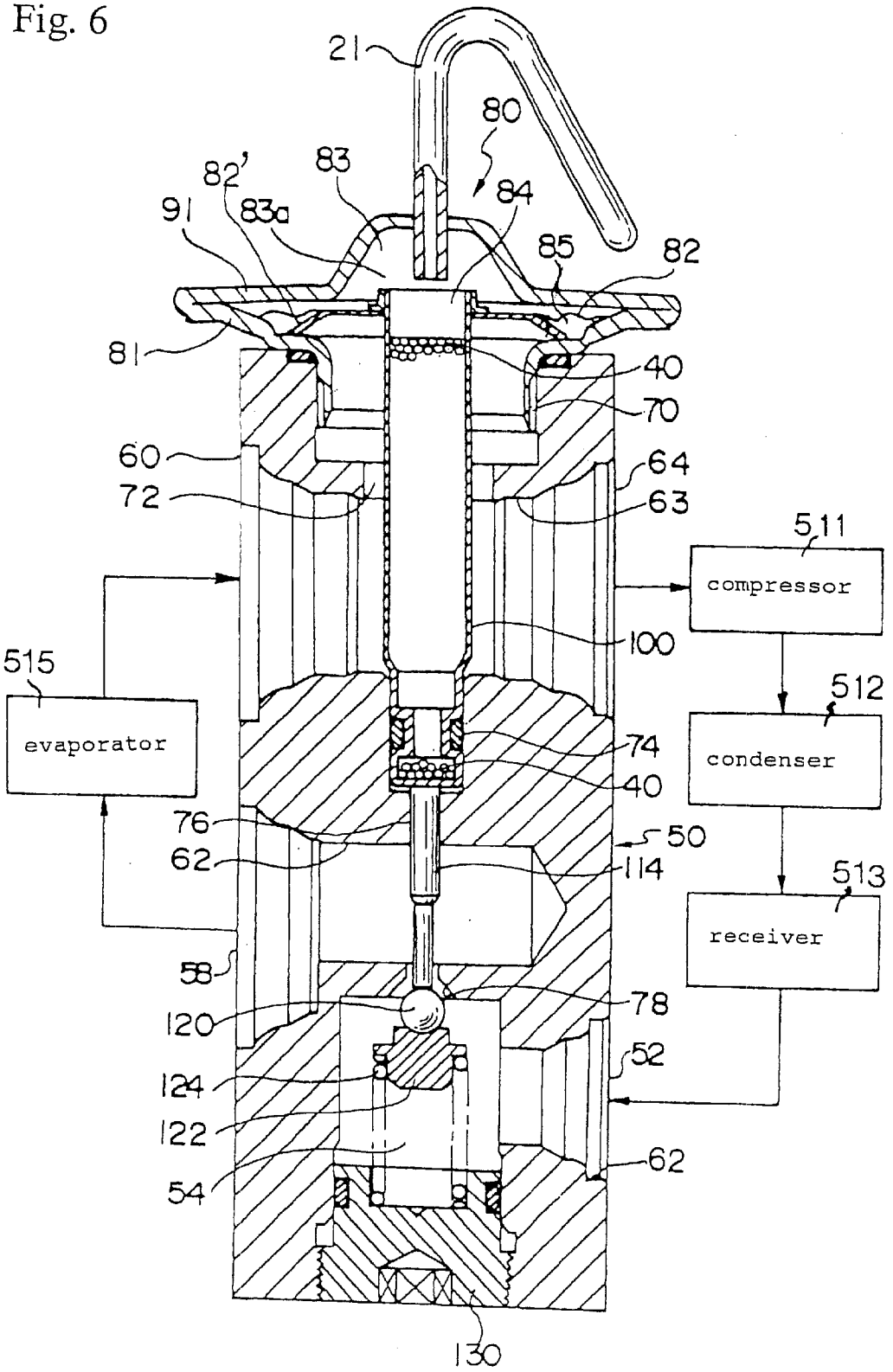
FIG. 6 is a vertical cross-sectional view showing another thermal expansion valve of the prior art.

Further, according to the embodiment of FIG. 1, a granular activated carbon is filled as the activated carbon 40 to the heat-sensing driven member 100, and the member 100 filled with granular activated carbon and the diaphragm 82 is welded together as explained in FIG. 2 to form an integral space 84 by the power element portion 80 and the heat-sensing driven member 100. A plug body 21' is used to seal the temperature-corresponding working fluid to the housing 91 defining the space 84. In another example, a small pipe as shown in FIG. 6 can be used instead of the plug 21' to degasify the housing, to fill the working fluid thereto, before sealing the end of the pipe.

FIG. 2 is a drawing showing the structure of the heat sensing driven member 100, the diaphragm 82 and the support member 82' according to the embodiment of FIG. 1.

As shown in FIG. 2(*a*), a collar 100*a* is formed to the exterior of the opening 100*b* of the heat-sensing driven member 100, and a protrusion 100*c* and a groove 100*d* are formed to the collar 100*a* toward the downward direction in the drawing. The protrusion 100*c* and the groove 100*d* are formed to the whole perimeter of the collar 100*a*.

Moreover, a diaphragm 82 made of stainless steel material and the like having an opening 82*a* formed to the center area thereof is inserted to the heat-sensing driven member 100 through the opening, and it is moved toward the direction of the arrow in FIG. 2(*a*) until the diaphragm contacts the protrusion 100*c*, and there the diaphragm 82 is fixed to the heat-sensing driven member 100.

A support member 82 made of stainless steel material and the like for supporting the diaphragm 82 and having an opening 82' a formed concentrically with the opening 82*a* of the diaphragm 82 is inserted to the heat-sensing driven member 100 through the opening, and it is moved toward the direction of the arrow in FIG. 2(*a*) until the support member contacts the diaphragm 82. The protrusion 100*c* and the support member 82' are pressed against each other at upper and lower electrodes (not shown) so that the support member is concentrical with the protrusion 100*c*, and current is applied to these electrodes to perform a so-called projection welding, thereby welding together the collar 100*a*, the diaphragm 82 and the support member 82' as shown in FIG. 2(*b*).

As a result, the diaphragm 82 is welded to position between the collar 100*a* and the support member 82' by protrusion 100*c*. The end portion of the diaphragm 82 is sandwiched between the housing 81 and 91, and welded thereto.

In the above embodiment, the heat transmission retardant member 140 that covers the external surface of the heat-sensing driven member 100 is mounted outside the second passage 63, thereby delaying further the response to the temperature variation of the refrigerant. However, the present invention is not limited to such example, but in another example, the tapered portion of the cup-like heat transmission retardant member can further be connected to. a thin-walled cylinder extension portion constituting a heat transmission retardant member covering the heat-sensing driven member, and the cylinder extension portion can be positioned within the second passage.

Figure 3:
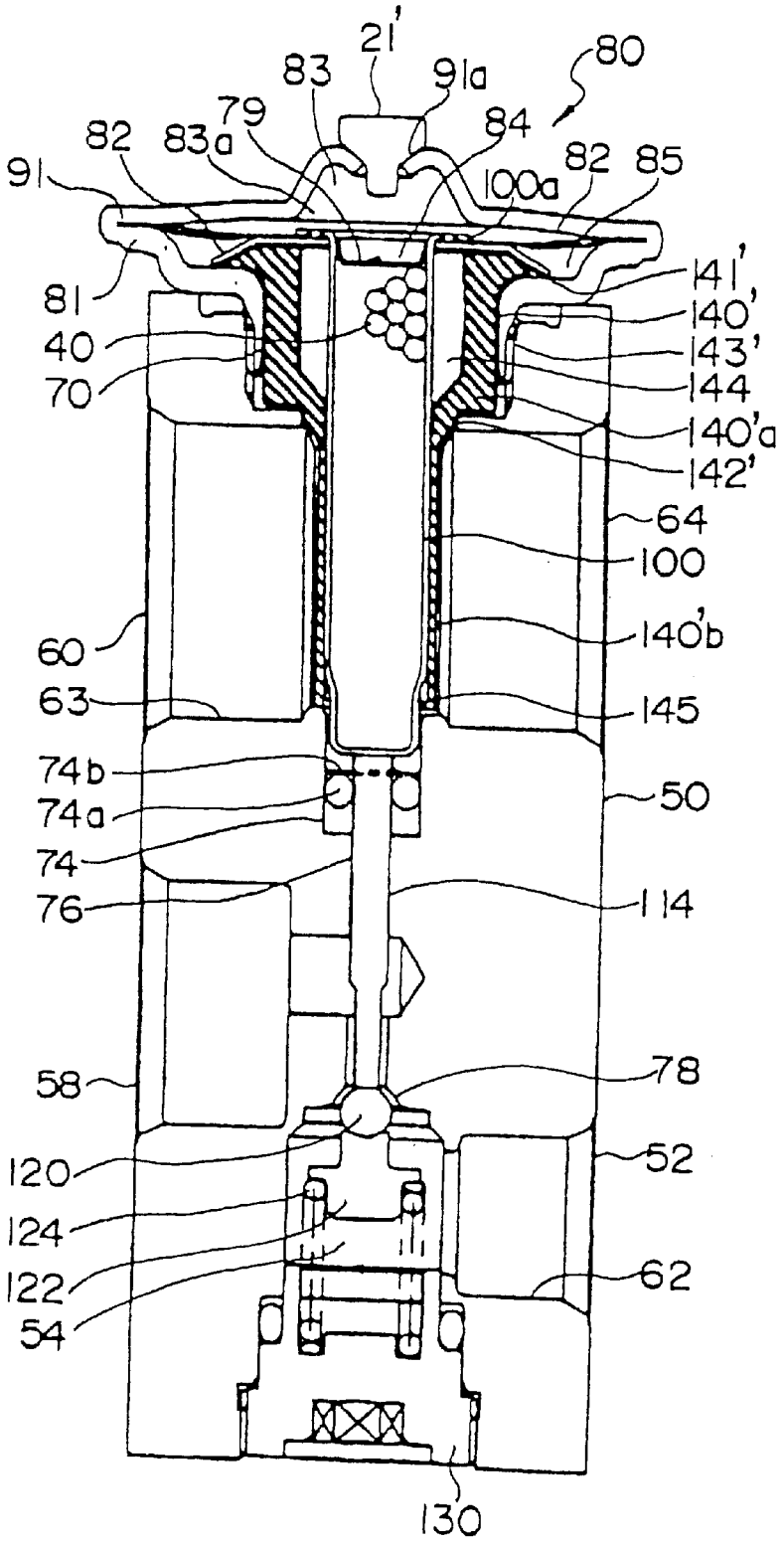
FIG. 3 is a vertical cross-sectional view showing another embodiment of the thermal expansion valve according to the present invention.

FIG. 3 shows an embodiment of the present invention where a heat transmission retardant member 140' comprises a cup-like thick-wall portion and an integrally formed thin-wall portion, and the structure of the present embodiment is identical to that shown in FIG. 1 except for the heat transmission retardant member 140', so the equivalent members are provided with the same reference numbers and the explanations thereof are omitted.

In FIG. 3, the heat transmission retardant member 140' comprises a cup-like thick-wall portion and a thin-wall portion formed integrally thereto, wherein the structure of the cup-like thick-wall portion 140'*a* is identical to that of the heat transmission retardant member 140 shown in FIG. 1 with a collar 141' formed to the exterior of the upper end surface, and a large-diameter cylinder portion 143' having a tapered portion 142' formed to the lower end thereof. The thin-wall portion comprises a cylinder extended portion 140'*b* extended downward from the tapered portion 142', and the thin-wall cylinder extended portion 140'*b* is arranged within the second passage 63, and the end of the cylinder extended portion 140'*b* is bent inward to form a contact portion 145 that mounts the retardant member 140' to the external surface of the heat-sensing driven member 100.

According to this structure, the area of the heat-sensing driven member 100 positioned within the second passage 63 is covered by the thin-wall cylinder extended portion 140'*b,* so that the thin-wall portion is also positioned within the passage 63, which delays the transmission of temperature variation of the refrigerant and further delays the response of the valve to the refrigerant temperature variation. Moreover, since the cylindrical extended portion 140'*b* has a thin wall, it allows to sense the refrigerant temperature without blocking the refrigerant flow, and to transmit the temperature change.

Figure 4:
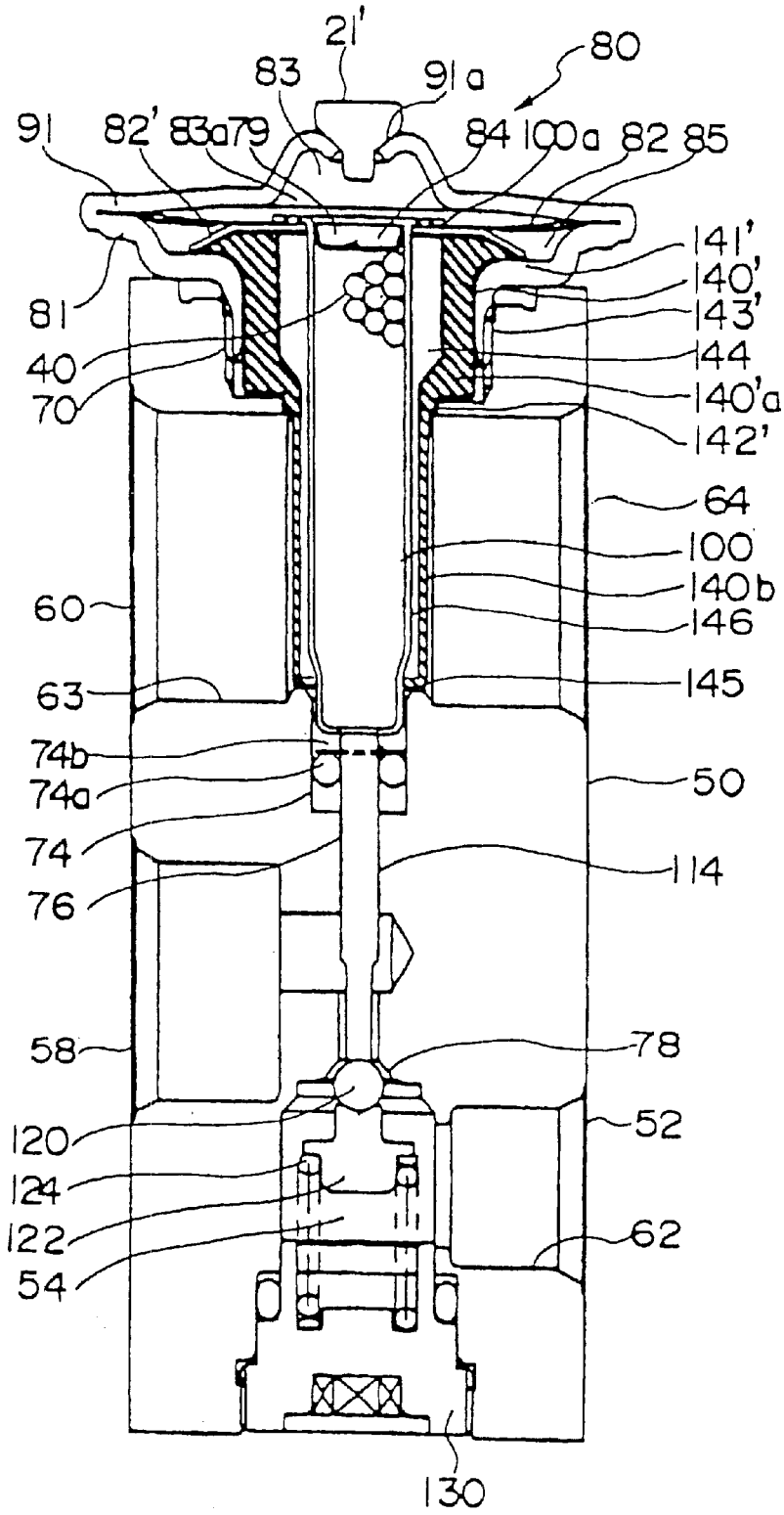
FIG. 4 is a vertical cross-sectional view showing yet another embodiment of the thermal expansion valve according to the present invention.
Figure 5:
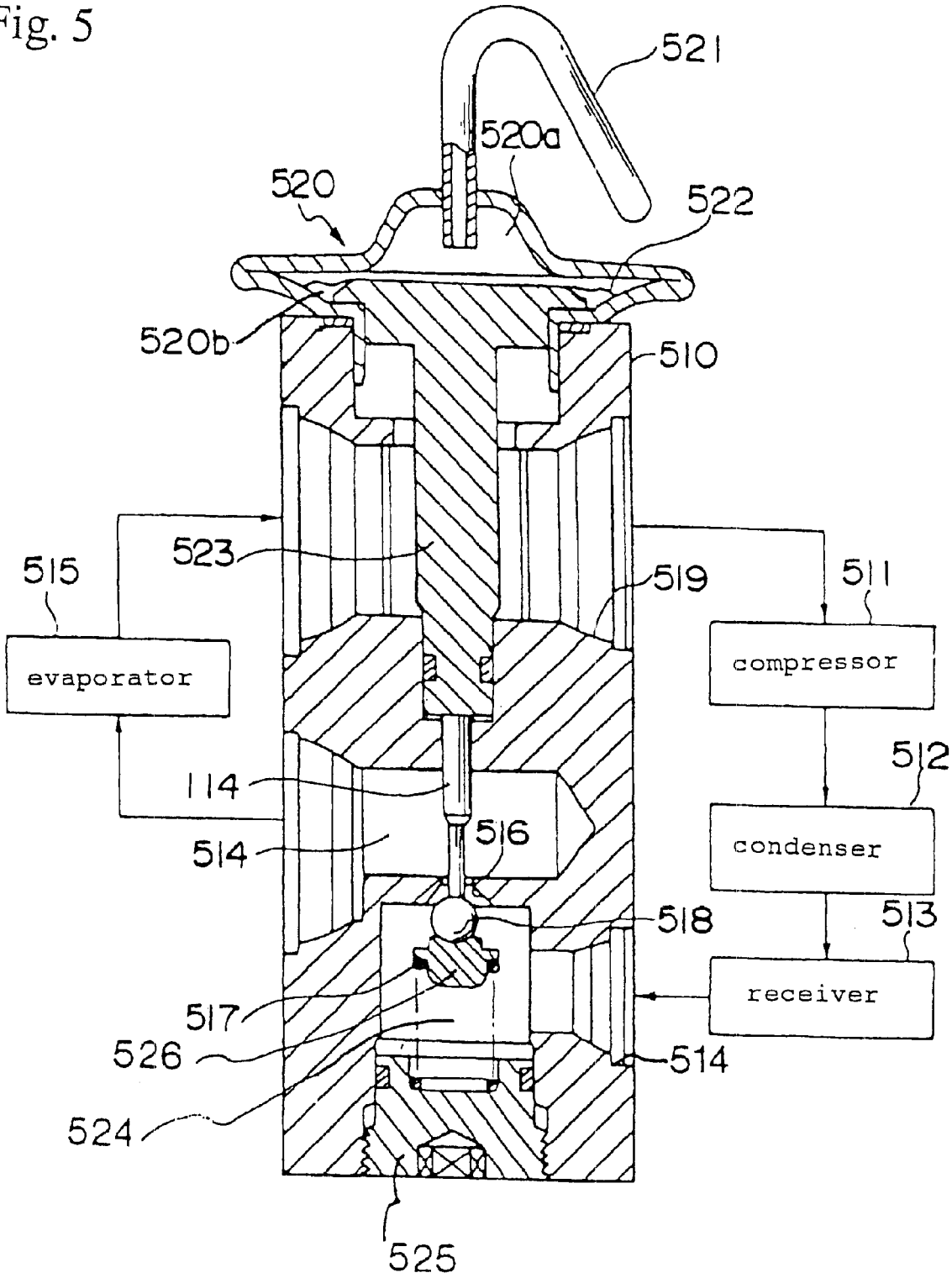
FIG. 5 is a vertical cross-sectional view showing the thermal expansion valve of the prior art.

FIG. 4 is a vertical cross-sectional view showing yet another embodiment of the thermal expansion valve according to the present invention. The embodiment shown in FIG. 4 is identical to that of FIG. 3 except that according to FIG. 4, a space is formed between the inner surface of the thin-wall cylindrical extended portion 140'*b* and the outer surface of the heat-sensing driven member 100, so the equivalent members are provided with the same reference numbers, and the explanations thereof are omitted. According to the embodiment of FIG. 4, the contact portion 145 is formed longer than the embodiment of FIG. 3, thereby creating a space 146 between the outer surface of the heat-sensing driven member 100 and the thin-wall cylindrical extended portion 140'*b*. According to such structure, the temperature variation of the refrigerant is transmitted from the heat transmission retardant member 140' via space 146 to the heat-sensing driven member 100, so the transmission of temperature change is even further delayed, and the response of the valve to the temperature variation of the refrigerant is thereby effectively delayed. The present embodiment suppresses the generation of hunting phenomenon even further.

The above embodiments utilize a separately formed support member and a heat transmission retardant member, but the present invention is also capable of utilizing a support member and a heat transmission retardant member integrally formed using a resin material. In this case, the collar 100*a* of the heat-sensing driven member and the diaphragm 82*a* are welded together as shown in FIG. 2.

As explained above, the thermal expansion valve according to the present invention includes a heat transmission retardant member mounted to the outer surface of the heat-sensing driven member with a space formed between the outer surface of the driven member and the inner surface of the retardant member, so that the temperature variation of the refrigerant is even further delayed while being transmitted to the heat-sensing driven member. This transmission delay realizes a further delay in the response of the valve to refrigerant temperature changes, thus effectively suppressing the hunting phenomenon. Moreover, the present invention achieves the above effects without changing the basic structure of the conventional thermal expansion valve but by applying a heat transmission retardant member thereto, enabling to provide an advantageous thermal expansion valve at low assembly cost and low manufacturing cost.

We claim:

1. A thermal expansion valve including a refrigerant passage extending from an evaporator to a compressor, and a heat-sensing driven member with a hollow portion formed to the interior thereof and having a heat sensing function that is positioned within said refrigerant passage; wherein the end of said hollow portion of said heat-sensing driven member is fixed to the center opening portion of a diaphragm constituting a power element portion that drives said driven member, thereby communicating said hollow portion with an upper pressure chamber defined by said diaphragm within said power element portion and forming a sealed space filled with working fluid, said hollow portion storing a time constant retardant material; and a heat transmission retardant member including a thick-wall portion and a thin-wall portion is mounted to and covers the outer circumferential surface of said heat-sensing driven member, said thick-wall portion mounted outside said refrigerant passage and forming a space between said outer circumferential surface, and said thin-wall portion mounted within said refrigerant passage.

2. A thermal expansion valve according to claim 1, wherein said thin-film portion is positioned within said refrigerant passage so as to form a space between said outer circumferential surface of said heat-sensing driven member.

* * * * *